US012799729B2

(12) United States Patent
He et al.

(10) Patent No.: US 12,799,729 B2
(45) Date of Patent: Nov. 17, 2026

(54) INTERFACE WITH ODOR-RESISTANT COMPONENT

(71) Applicant: Taizhou Luqiao JOYHOO Sanitary Ware Factory, Zhejiang (CN)

(72) Inventors: Shumin He, Zhejiang (CN); Chao Xiao, Zhejiang (CN)

( * ) Notice: Subject to any disclaimer, the term of this patent is extended or adjusted under 35 U.S.C. 154(b) by 259 days.

(21) Appl. No.: 18/762,579

(22) Filed: Jul. 2, 2024

(65) Prior Publication Data

US 2024/0352721 A1 Oct. 24, 2024

(30) Foreign Application Priority Data

Jul. 4, 2023 (CN) ..... 202321739431.0

(51) Int. Cl.
*E03F 5/04* (2006.01)

(52) U.S. Cl.
CPC ..... *E03F 5/04* (2013.01); *E03F 2005/0416* (2013.01)

(58) Field of Classification Search
CPC ..... E03F 5/041; E03F 5/0406; E03F 5/0405; E03F 5/04; E03F 2005/0416
USPC ..... 4/286
See application file for complete search history.

(56) References Cited

U.S. PATENT DOCUMENTS

2022/0074188 A1* 3/2022 Park ..... E03F 5/0405

* cited by examiner

*Primary Examiner* — Lauren A Crane
(74) *Attorney, Agent, or Firm* — Hawaii Patent Services; Nathaniel K. Fedde; Kenton N. Fedde

(57) ABSTRACT

An interface with an odor-resistant component comprises a shell and an odor-resistant component, wherein an accommodating cavity is arranged on the shell; the odor-resistant component is arranged in the accommodating cavity; the interface is characterized by further comprising a cover plate, wherein the odor-resistant component comprises a fixed seat and a flip cover hinged on the fixed seat; the fixed seat is arranged on the cover plate, the shell is provided with an opening communicated with the accommodating cavity; and the cover plate is arranged at the opening and is detachably connected with the shell

17 Claims, 9 Drawing Sheets

INTERFACE WITH ODOR-RESISTANT COMPONENT

CROSS-REFERENCE TO RELATED APPLICATIONS

This application claims the priority of China Patent Application No. 202321739431.0 filed on Jul. 4, 2023, entitled "Interface With Odor-resistant Component", the entire contents of which, including the amendments therein, are all incorporated herein by reference.

TECHNICAL FIELD

The present invention relates to the technical field of pipeline odor-resistant plugs, in particular to an interface with an odor-resistant component.

BACKGROUND

The floor drain used indoors in buildings may easily entrain sand and hair, and impurities such as fiber fabrics are easy to block at the lower through hole, which causes some trouble to the floor drain and is extremely difficult to clean and eliminate; and the floor drain is connected with the drainage pipeline arranged on the ground. In use, the phenomena of easy blockage, anti-water, anti-odor, etc. may occur for the conventional floor drain often, which often causes a lot of troubles in domestic use, so people often put the pipeline odor-resistant plug in the floor drain.

In the prior art, for example, U.S. Pat. No. 11,753,811, there is provided an apparatus for preventing offensive odors for a drain port; it deodorizes through an odor-resistant component mounted at the water outlet, and the odor-resistant component is opened to connect or disconnect the opening. In the process of downward flow of water, the odor-resistant component is opened due to the impact of the water flow, and the water flow can normally flow to a sewer pipe, and the odor-resistant component is closed under the condition of no water flow to prevent the odor of the sewer pipe from flowing upward. For example, U.S. patent publication No. US20130000035A1 further provides a wastewater discharge device, which can be quickly mounted under the floor drain and deodorized by providing a detachable odor-resistant device to block odor.

However, the odor-resistant component of the odor-resistant device disclosed above is not detachable or difficult to disassemble after installation, and thus it is inconvenient to maintain when replacement and cleaning are needed, and the odor-resistant effect cannot be achieved after long-term use.

Based on the above problems, it is necessary to propose an interface with an odor-resistant component, which has a detachable odor-resistant component and is easy to replace, so that the odor-resistant effect is good, and the structure is simple and the replacement is convenient.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The present invention provides an interface with an odor-resistant component, which includes a shell and the odor-resistant component, wherein the shell is provided with an accommodating cavity, and the odor-resistant component is arranged in the accommodating cavity; the interface further comprises a cover plate, wherein the odor-resistant component comprises a fixed seat and a flip cover hinged on the fixed seat; the fixed seat is arranged on the cover plate, the shell is provided with an opening communicated with the accommodating cavity, and the cover plate cover is arranged at the opening and is detachably connected with the shell.

The present invention further provides an interface with an odor-resistant component, which includes a shell and an odor-resistant component, wherein the shell is provided with an accommodating cavity, the odor-resistant component is arranged in the accommodating cavity, and the interface further comprises a cover plate, wherein the odor-resistant component comprises a fixed seat and a flip cover hinged on the fixed seat; the fixed seat is arranged on the cover plate, the shell is provided with an opening communicated with the accommodating cavity, and the cover plate covers the opening and is detachably connected with the shell; the shell is provided with two oppositely arranged limit grooves, and the cover plate is correspondingly provided with limit blocks which are clamped in the limit grooves so as to limit the axial sliding of the cover plate; an inner side wall of the shell is respectively provided with hooks on both sides of the limit grooves, the cover plate is provided with a first boss, and the hooks are hooked on the first boss so as to limit the lateral sliding of the cover plate.

The present invention further provides an interface with an odor-resistant component, including a shell and an odor-resistant component;

- the shell comprises a channel between an inlet and an outlet and a mounting groove communicated with the channel;
- the odor-resistant component is mounted in the shell through the mounting groove to block the channel, and the odor-resistant component comprises a fixed seat with an opening and a mounting part detachably connected with the mounting groove;
- the fixed seat is movably connected with a flip cover covering the opening, and the flip cover is opened by a fluid entering the channel to open up the channel or is closed by a load to block the channel.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
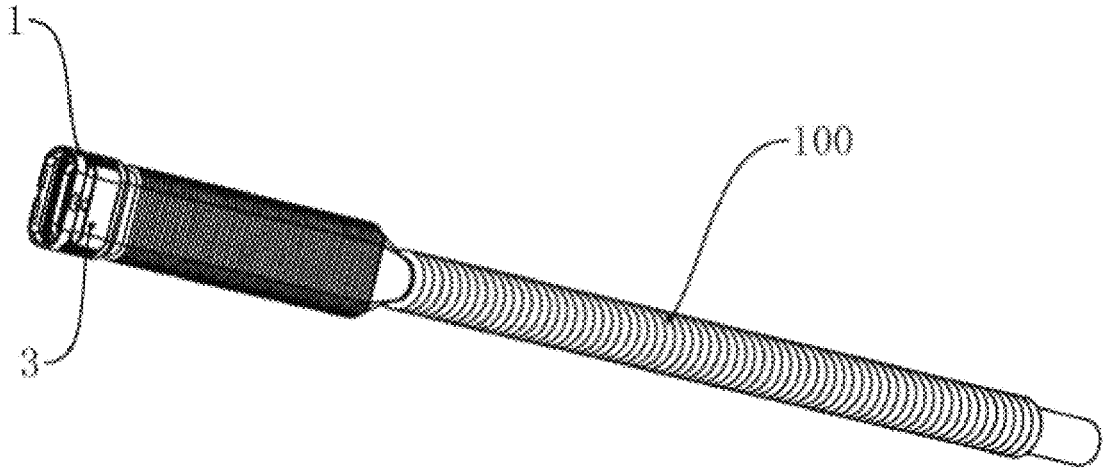
FIG. 1 is a schematic diagram of the connection with a pipeline according to a specific embodiment of the present invention.

Shell (1); Odor-resistant component (2); Cover plate (3); Sealing ring (4); Buckle (5); First seal (6); Accommodating cavity (11); Limit groove (13); Hook (14); Connecting hook (15); Second convex rib (16); Second positioning groove (17); Fixed seat (21); Flip cover (22); Clamping groove (31); Limit block (32); First boss (33); First convex rib (34); First positioning groove (35); Second boss (36); Stop block (51); Pipeline (100).

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

Figure 2:
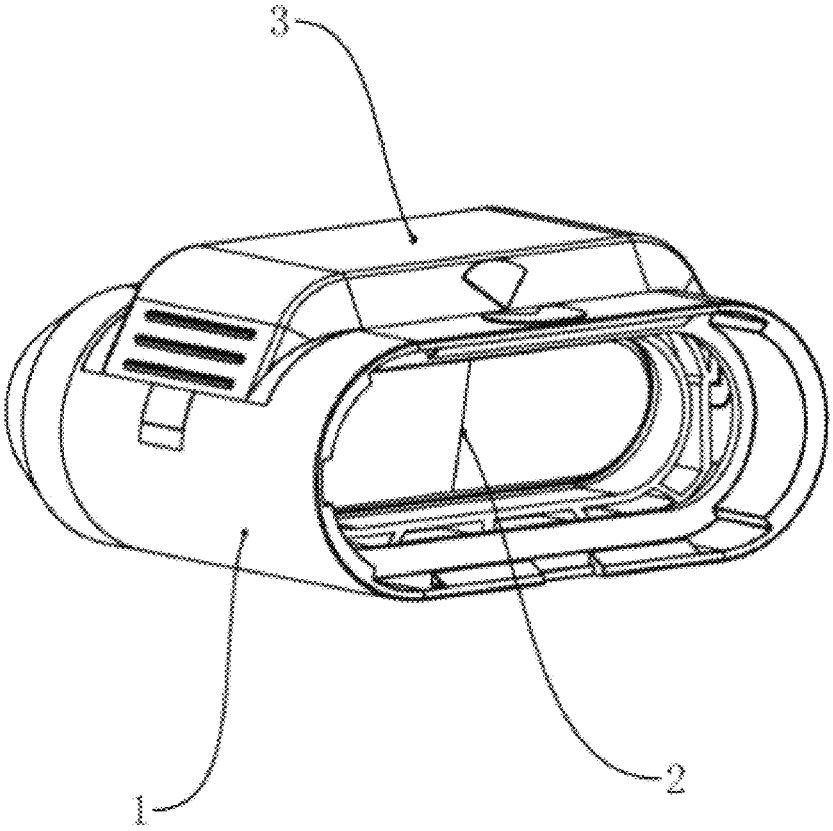
FIG. 2 is a structural schematic diagram of a specific embodiment of the present invention.
Figure 3:
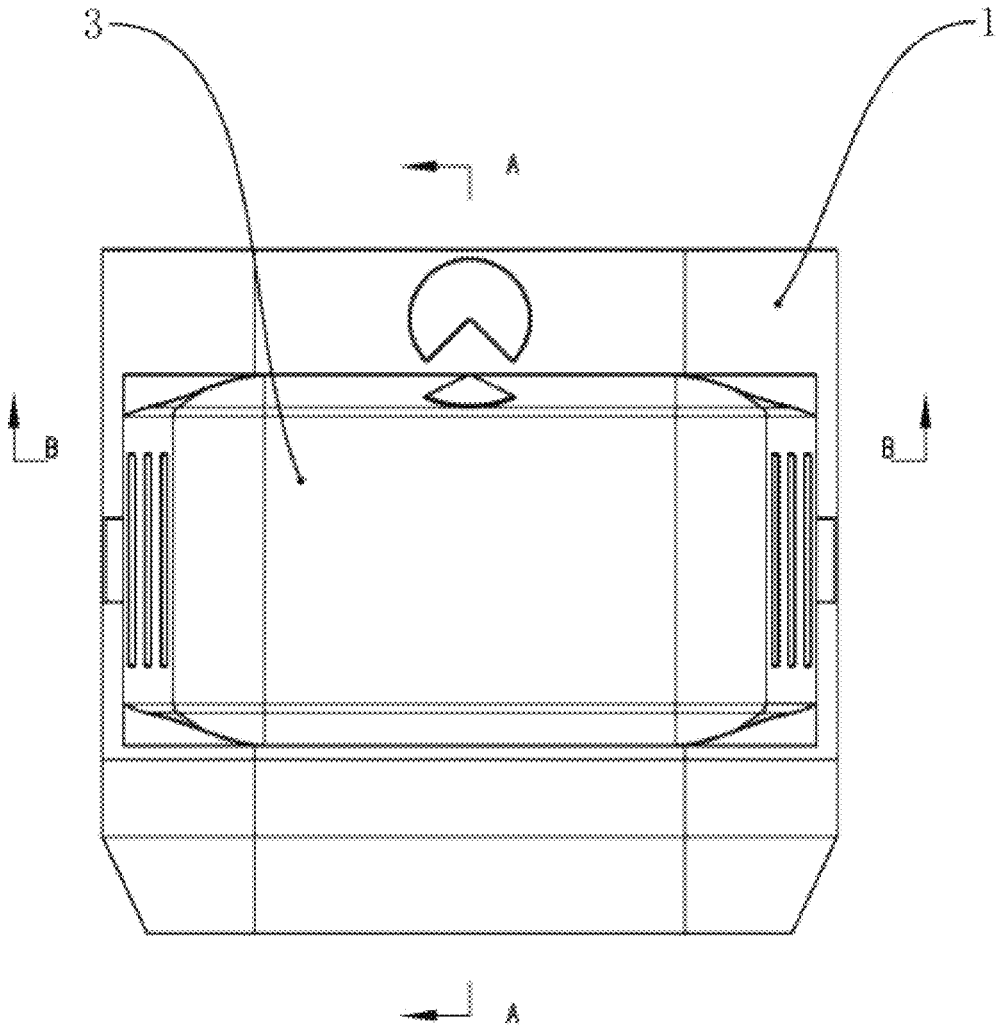
FIG. 3 is a front view of a specific embodiment of the present invention.
Figure 4:
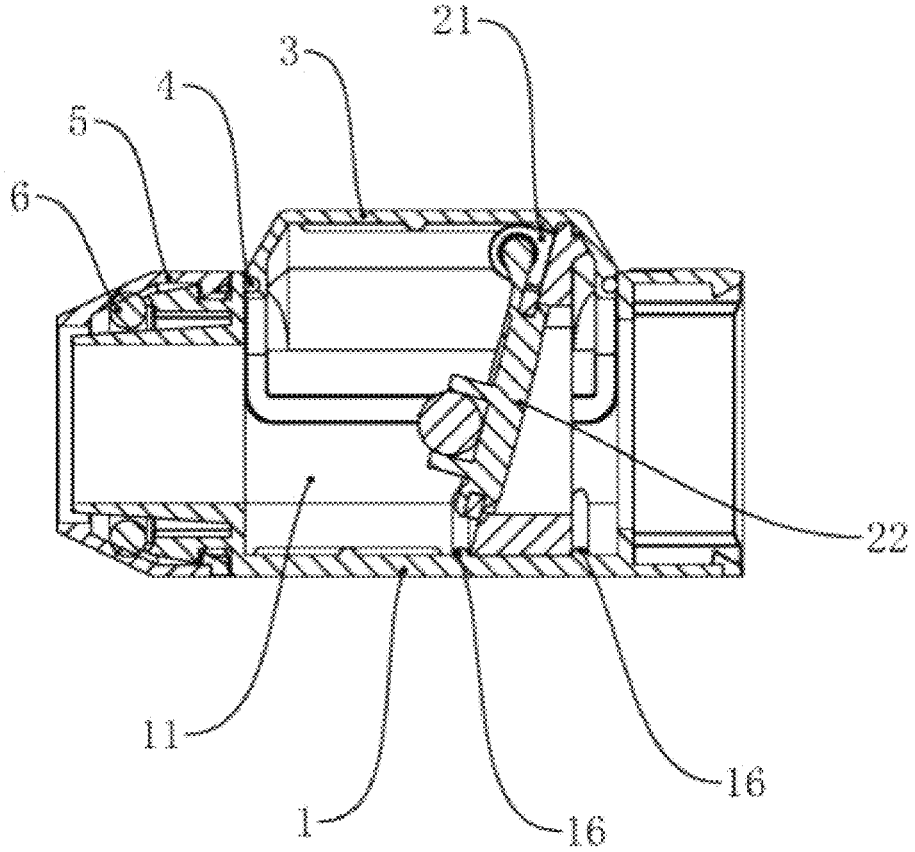
FIG. 4 is a sectional view taken along the line A-A in FIG. 3.
Figure 5:
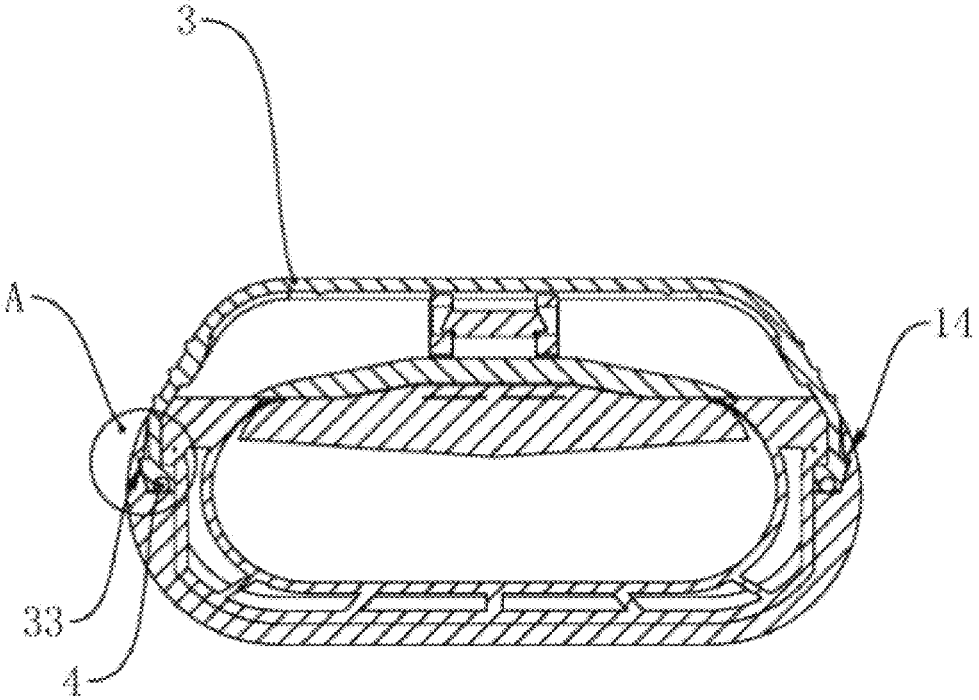
FIG. 5 is a sectional view taken along the line B-B in FIG. 3.
Figure 6:
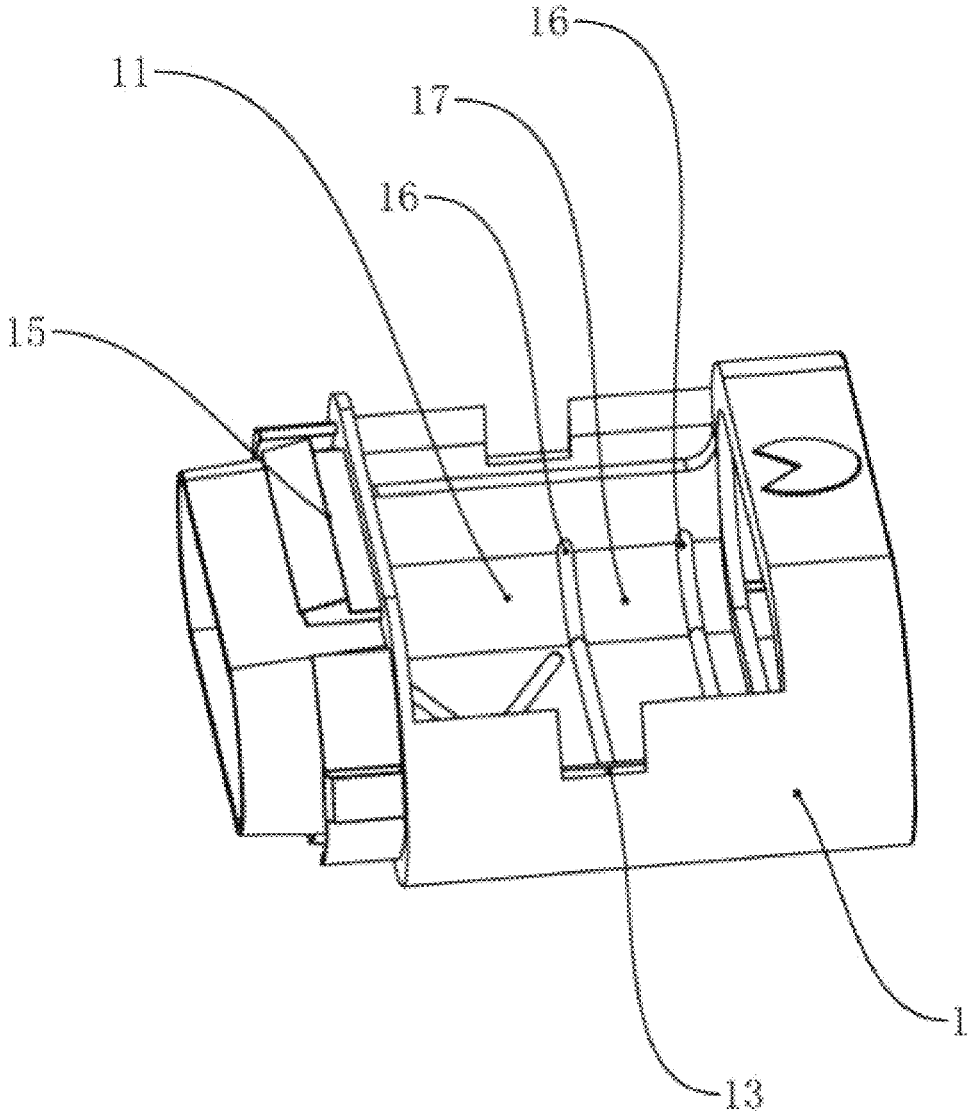
FIG. 6 is a schematic diagram of a shell according to a specific embodiment of the present invention.
Figure 7:
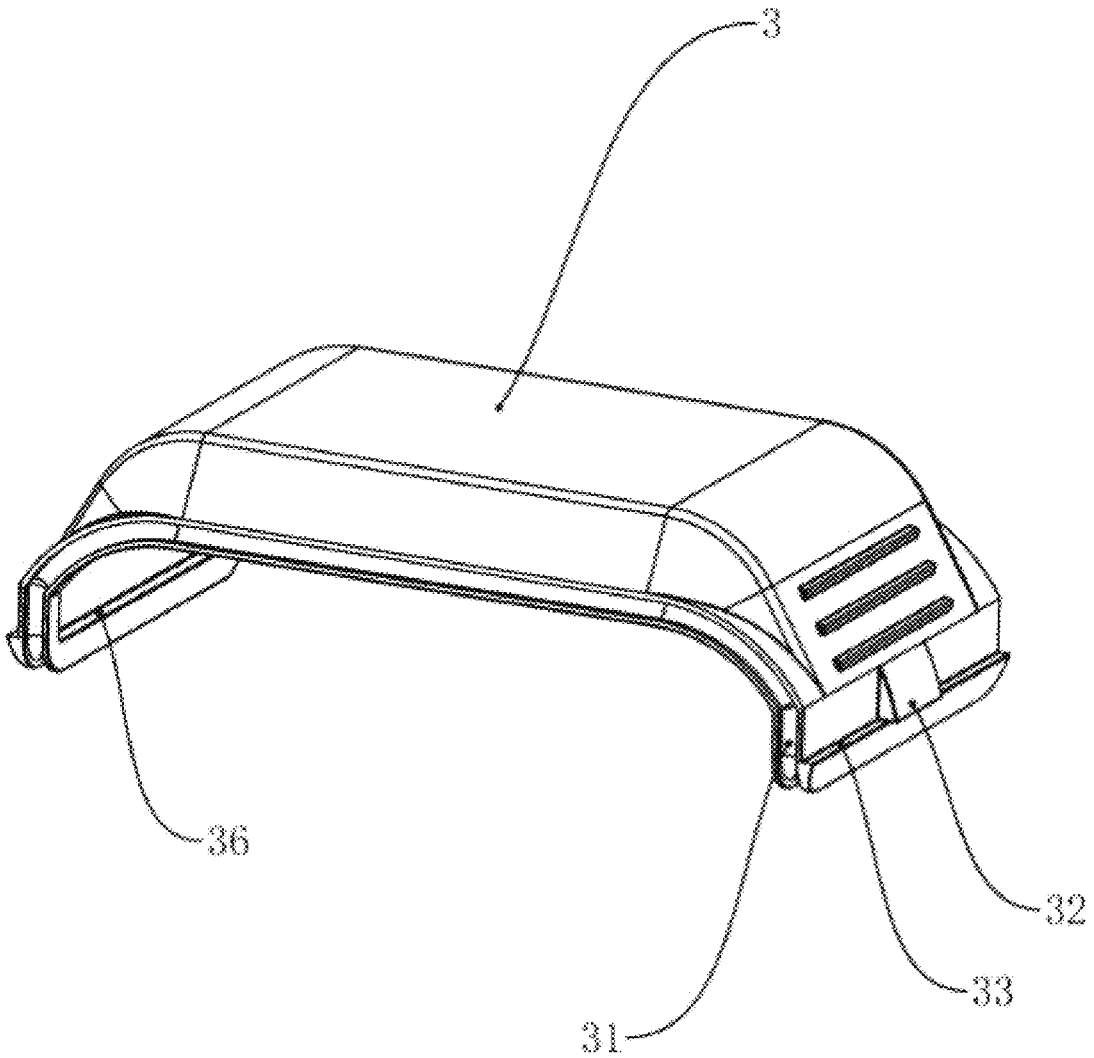
FIG. 7 is a schematic diagram of a cover plate according to a specific embodiment of the present invention.
Figure 8:
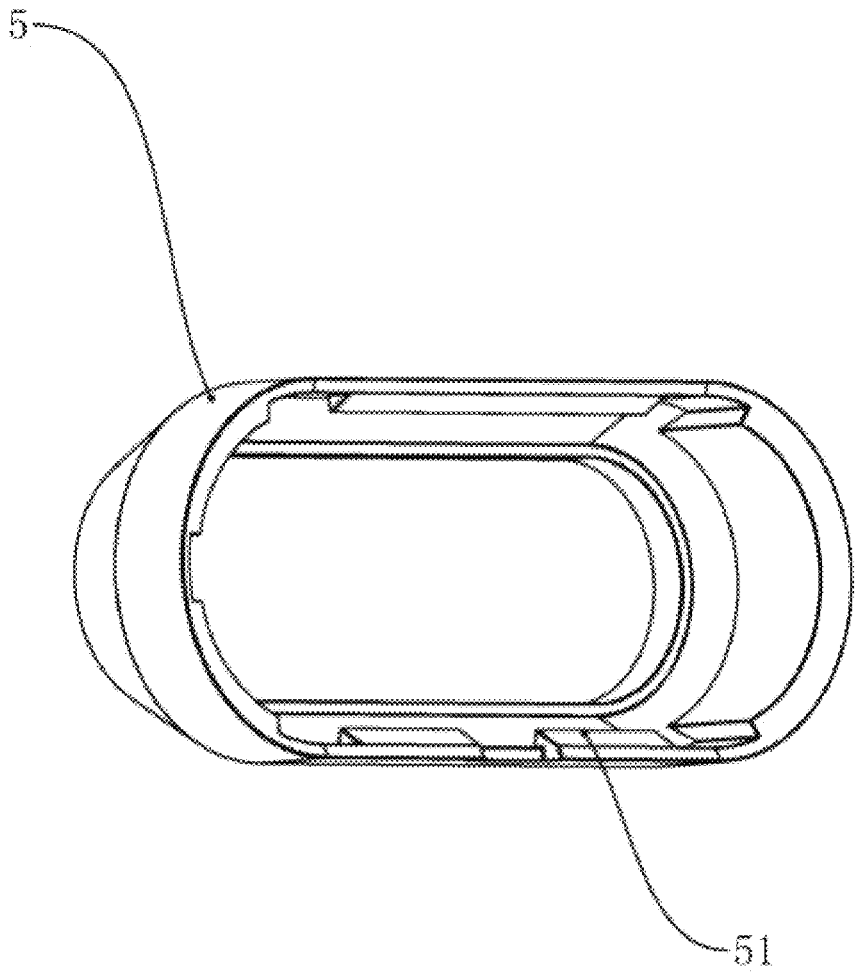
FIG. 8 is a schematic diagram of a buckle according to a specific embodiment of the present invention.
Figure 9:
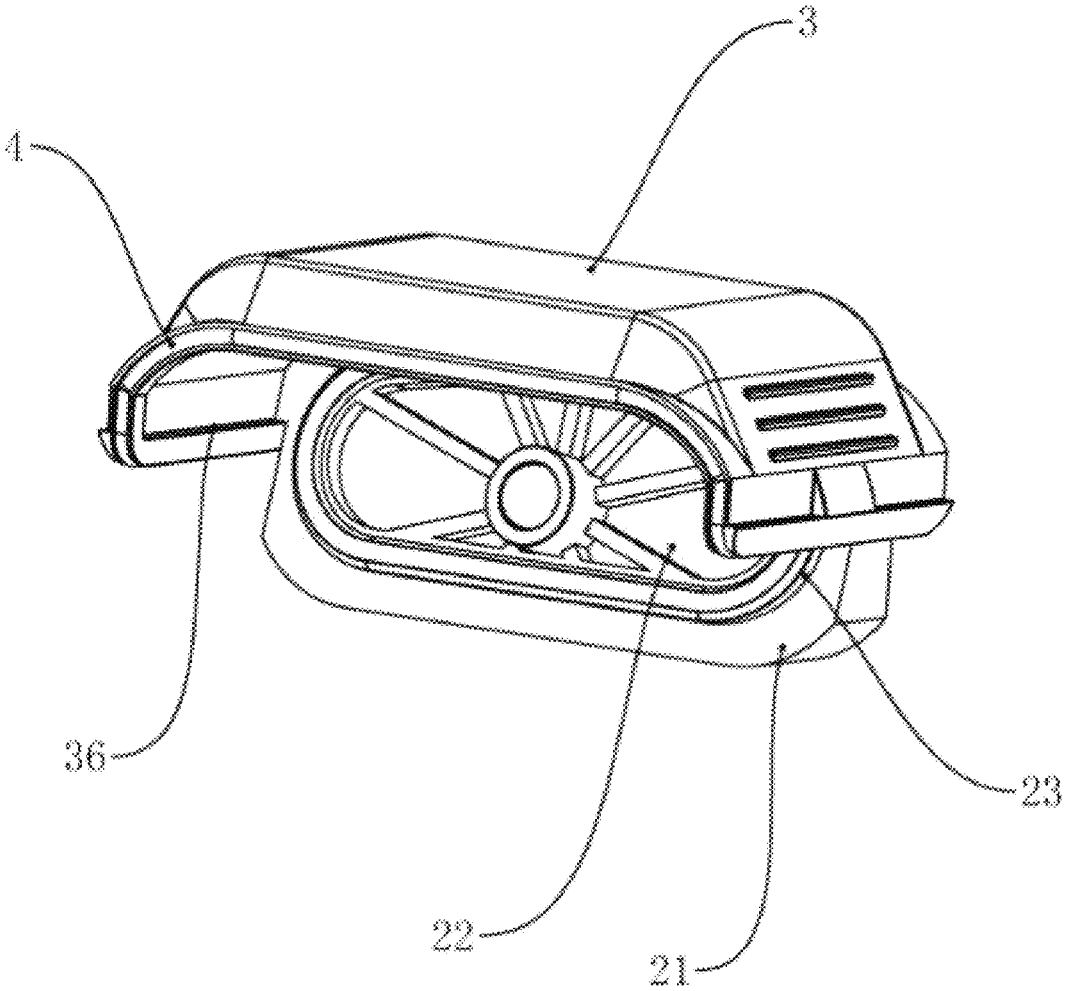
FIG. 9 is a schematic diagram of the cover plate and the odor-resistant component according to a specific embodiment of the present invention.
Figure 10:
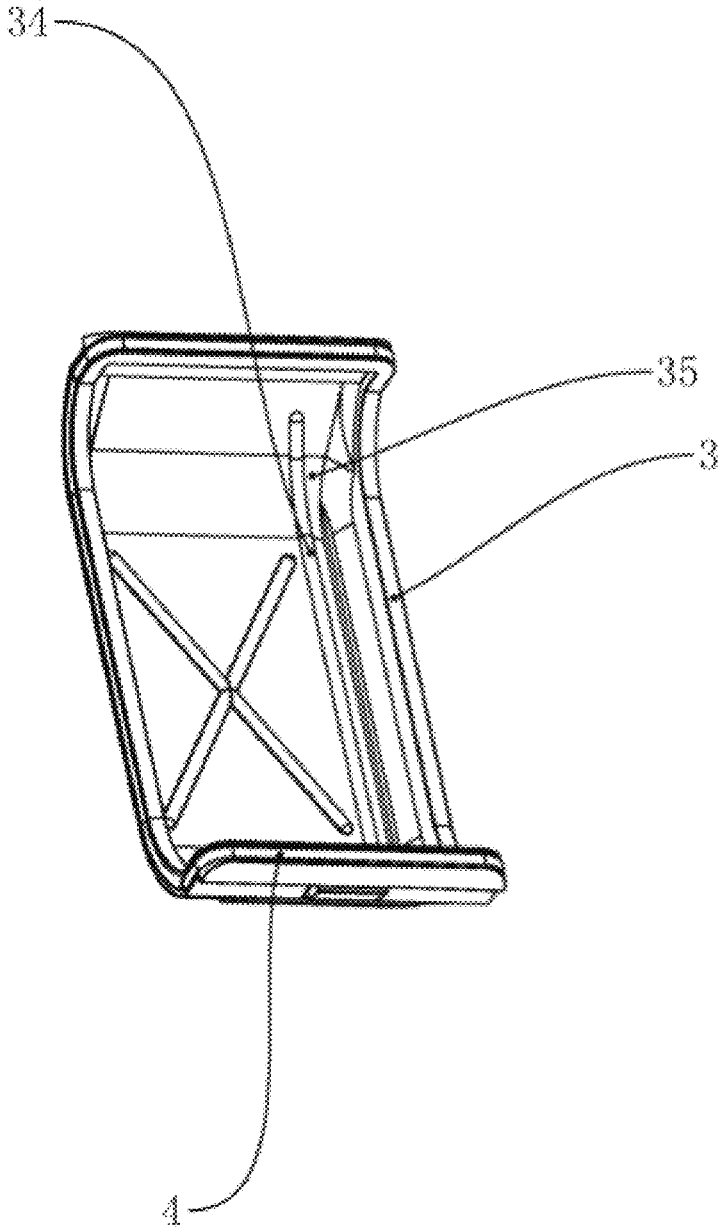
FIG. 10 is a schematic diagram of a cover plate according to a specific embodiment of the present invention.
Figure 11:
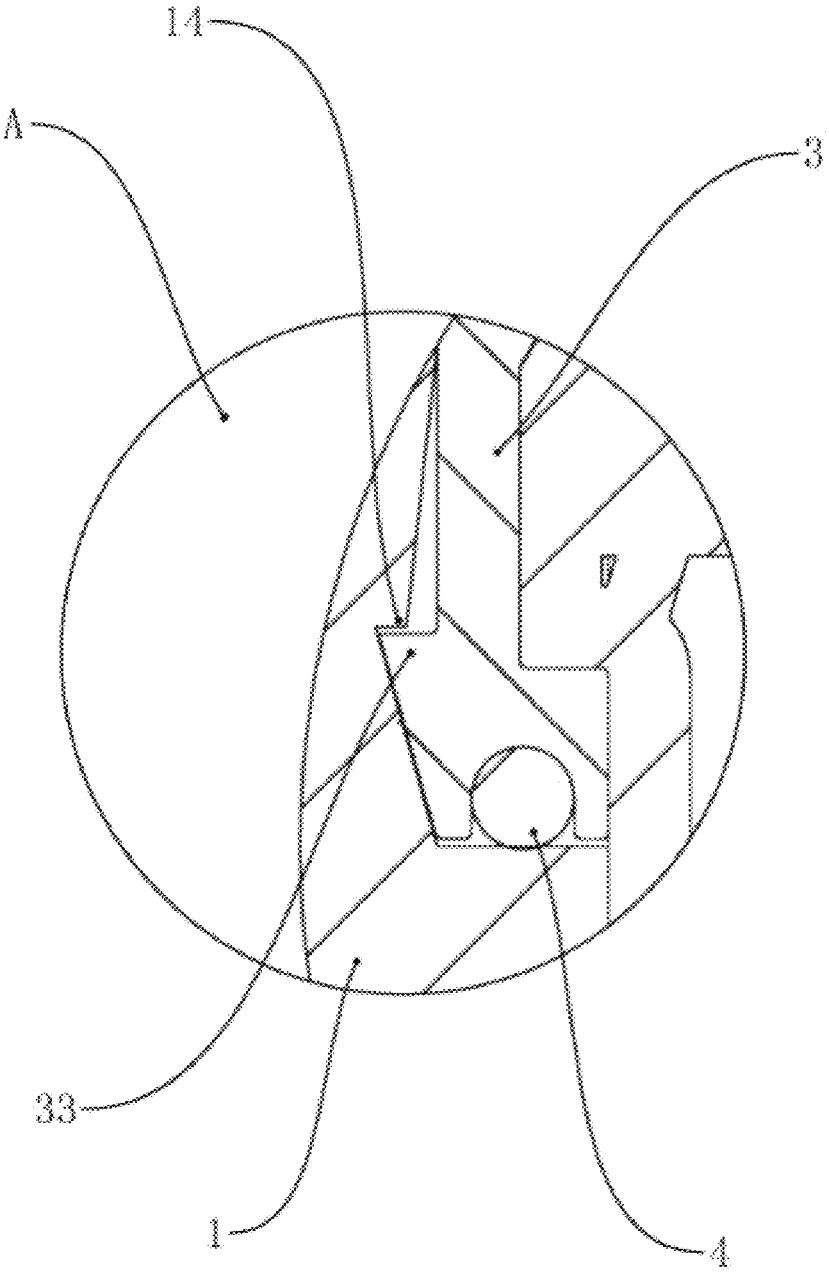
FIG. 11 is an enlarged view of part A in FIG. 5.

As shown in FIGS. 1 to 11, the present invention provides an interface with an odor-resistant component, which includes a shell 1 and an odor-resistant component 2, wherein an accommodating cavity 11 is arranged on the shell 1; two ends of the shell 1 are open and pass through the accommodating cavity, and the two ends of the shell are flat-mouthed, so that the interface is small in size and cost is saved; and the odor-resistant component 2 is arranged in the accommodating cavity 11 and further includes a cover plate 3; the odor-resistant component 2 includes a fixed seat 21 and a flip cover 22 hinged on the fixed seat 21, and the flip cover 22 is hinged on the fixed seat 21 through a hinge shaft; the flip cover 22 is opened due to the impact of water flow, so that the water flow can normally flow to the sewer pipe, and the odor-resistant component is closed under the condition of no water flow, so as to prevent the odor of the sewer pipe from flowing upwards and realize deodorization; a second seal 23 is arranged between the fixed seat 21 and the flip cover 22, so that the sealing effect is good and odor is prevented from overflowing; the fixed seat 21 is arranged on the cover plate 3, and the shell 1 is provided with an opening communicated with the accommodating cavity 11; the cover plate 3 covers the opening and is detachably connected with the shell 1; the cover plate 3 can be detached from the shell 1 to drive the odor-resistant component 2 to be taken out of the shell 1, so that the odor-resistant component 2 can be cleaned or replaced, so that the odor-resistant effect is good, and the problem that the odor-resistant component cannot be disassembled in the prior art is solved.

The cover plate 3 is provided with a clamping groove 31 along its circumferential direction, and a sealing ring 4 is arranged in the clamping groove 31, so that the sealing performance between the cover plate 3 and the shell 1 is good, and water or air suction is prevented from flowing out from the gap between the cover plate and the shell.

The shell 1 is provided with two oppositely arranged limit grooves 13, and the cover plate 3 is correspondingly provided with limit blocks 32, which are clamped in the limit grooves 13 to limit the axial sliding of the cover plate 3. The inner side wall of the shell 1 is respectively provided with hooks 14 on both sides of the limit grooves 13, and the cover plate 3 is provided with a first boss 33, and the hooks 14 are hooked on the first boss 33 to limit the lateral sliding of the cover plate 3. The connection structure between the shell 1 and the cover plate 3 is simple, which is convenient for disassembling. When disassembling, the cover plate 3 is pressed inward from both sides, and the cover plate 3 is made of a plastic material, so that the cover plate 3 is elastically deformed, and the first boss 33 is separated from the hook 14, so that the cover plate 3 can be disassembled from the shell 1.

The interface further includes a buckle 5, which is detachably connected with the shell 1. Specifically, a connecting hook 15 is arranged on the side wall of one end of the shell 1 connected with the pipeline 100; a stop block 51 is arranged on the buckle 5, and the connecting hook 15 is hooked on the stop block 51 to realize the connection between the buckle 5 and the shell 1. A first seal 6 is arranged between the buckle 5 and the shell 1, and the seal is arranged by a sealing ring or a gasket. The corrugated pipe is mounted on the shell by the buckle, and the seal is convenient to assemble and disassemble.

The upper side wall of the cover plate 3 is provided with a first convex rib 34, and a first positioning groove 35 is formed between the first convex rib 34 and the side wall. The upper end of the fixed seat 21 is clamped in the first positioning groove 35, and the two inner side walls of the cover plate 3 are provided with second bosses 36. The middle part of the fixed seat 21 is erected on the second bosses 36, which is simple in structure and convenient to install. Two second convex ribs 16 are arranged on the inner side wall of the shell 1. The two second convex ribs 16 are arranged at intervals to form a second positioning groove 17, and the lower end of the fixed seat 21 is clamped in the second positioning groove 17, so that the structure of the fixed seat 21 is firm and stable, and will not be displaced under the influence of water flow.

The present invention further provides an interface with an odor-resistant component, which includes a shell 1 and an odor-resistant component 2; the shell 1 includes a channel between an inlet and an outlet and a mounting groove communicated with the channel; the periphery of the odor-resistant component 2 is provided with a seal which tightly seals the inner wall of the shell 1; the odor-resistant component 2 is installed into the shell 1 through the mounting groove to block the channel; the odor-resistant component 2 includes a fixed seat 21 with an opening and a mounting part which is detachably connected with the mounting groove; wherein, the fixed seat 21 is movably connected with a flip cover 22 covering the opening, and the flip cover 22 is opened by a fluid entering the channel to open up the channel or is closed by a load to block the channel.

The cover plate 3 is provided with a clamping groove 31 along its circumferential direction, and a sealing ring 4 is arranged in the clamping groove 31, so that the sealing performance between the cover plate 3 and the shell 1 is good, and water or air suction is prevented from flowing out from the gap between the cover plate and the shell.

The mounting groove is opened on the outer wall of the shell, and there are two oppositely arranged limit grooves 13 in the mounting groove. The mounting part includes a cover plate 3, on which there are corresponding limit blocks 32 matched with the limit grooves 13; the limit grooves 13 on both sides are respectively provided with hooks 14, and the cover plate 3 is provided with a first boss 33, and when the limit blocks 32 are mounted in the limit grooves 13, the hooks 14 are hooked on the first boss to limit the loosening of the cover plate 3. The connection structure between the shell 1 and the cover plate 3 is simple, which is convenient for disassembling. When disassembling, the cover plate 3 is pressed inward from both sides, and the cover plate 3 is made of a plastic material, so that the cover plate 3 is elastically deformed, and the first boss 33 is separated from the hook 14, so that the cover plate 3 can be disassembled from the shell 1.

The flip cover 22 is connected with the fixed seat 21 through a hinge shaft, and the hinge shaft is arranged above the opening of the fixed seat 21. The flip cover 22 is provided with a counterweight ball which forms a load on the flip cover 22. In some embodiments (not shown in the figure), the load on the flip cover 22 can also be realized by arranging an elastic member, which is arranged between the flip cover 22 and the fixed seat 21 to drive the flip cover 22 to keep covering the opening; this arrangement makes the flip cover not limited to the mode of lifting up to open, that is, the hinge shaft is not limited to being arranged above the opening of the fixed seat 21, but may also be arranged at the side of the opening of the fixed seat 21. Secondly, the interface with the odor-resistant component can also be arranged vertically, and the flip cover 22 can keep covering the opening against gravity through the elastic member.

The upper side wall of the cover plate 3 is provided with a first convex rib 34, and a first positioning groove 35 is formed between the first convex rib 34 and the side wall. The upper end of the fixed seat 21 is clamped in the first positioning groove 35, and the two inner side walls of the cover plate 3 are provided with second bosses 36. The middle part of the fixed seat 21 is erected on the second bosses 36, which is simple in structure and convenient to install. Two second convex ribs 16 are arranged on the inner side wall of the shell 1. Two second convex ribs 16 are arranged at intervals to form a second positioning groove 17, and the lower end of the fixed seat 21 is clamped in the second positioning groove 17, so that the structure of the fixed seat 21 is firm and stable, and will not be displaced under the influence of water flow.

The cover plate 3 is provided with a first positioning groove 35 for clamping the fixed seat 21, so that the fixed seat 21 can be detachably mounted on the cover plate 3, and when cleaning is needed, the fixed seat 21 can be directly detached for cleaning.

The interface with an odor-resistant component also includes a buckle 5, which is detachably connected with the shell 1. Specifically, a connecting hook 15 is arranged on the side wall of one end of the shell 1 connected with the pipeline 100, and a stop block 51 is arranged on the buckle 5. The connecting hook 15 is hooked on the stop block 51 to realize the connection between the buckle and the shell, and a first seal 6 is arranged between the buckle 5 and the shell 1, and the seal is set as a sealing ring or a gasket. A corrugated pipe is mounted on the shell by the buckle, which is convenient to assemble and disassemble, and the seal makes the sealing effect good, and prevents water or air suction from leaking from the joint.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

The invention has now been described in detail for the purposes of clarity and understanding. However, those skilled in the art will appreciate that certain changes and modifications may be practiced within the scope of the appended claims.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for case of explanation only and are not meant to be limiting.

The various features and processes described above may be used independently of one another, or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

What is claimed is:

1. An interface with an odor-resistant component, comprising a shell and the odor-resistant component, wherein the shell is provided with an accommodating cavity, and the odor-resistant component is arranged in the accommodating cavity; the interface further comprises a cover plate, wherein the odor-resistant component comprises a fixed seat and a flip cover hinged on the fixed seat; the fixed seat is arranged on the cover plate, the shell is provided with an opening communicated with the accommodating cavity, the cover plate is arranged at the opening and is detachably connected with the shell, and wherein a clamping groove is arranged on the cover plate along a circumference thereof, and a sealing ring is arranged in the clamping groove.

2. The interface with an odor-resistant component according to claim 1, wherein the shell is provided with two oppositely arranged limit grooves, and the cover plate is correspondingly provided with limit blocks, which are clamped in the limit grooves to limit axial sliding of the cover plate; an inner side wall of the shell is respectively provided with hooks on both sides of the limit grooves, and the cover plate is provided with a first boss, and the hooks are hooked on the first boss to limit lateral sliding of the cover plate.

3. The interface with an odor-resistant component according to claim 1, further comprising a buckle, wherein the buckle is detachably connected with the shell, and a first seal is arranged between the buckle and the shell.

4. The interface with an odor-resistant component according to claim 1, wherein an upper side wall of the cover plate is provided with a first convex rib, and a first positioning groove is formed between the first convex rib and the upper side wall, and an upper end of the fixed seat is clamped in the first positioning groove.

5. The interface with an odor-resistant component according to claim 4, wherein two inner side walls of the cover plate are provided with second bosses, and a middle part of the fixed seat is erected on the second bosses.

6. The interface with an odor-resistant component according to claim 1, wherein a seal is arranged between the fixed seat and the flip cover.

7. The interface with an odor-resistant component according to claim 4, wherein two second convex ribs are arranged on an inner side wall of the shell, and the two second convex ribs are arranged at intervals to form a second positioning groove, and a lower end of the fixed seat is clamped in the second positioning groove.

8. An interface with an odor-resistant component, comprising a shell and an odor-resistant component, wherein the shell is provided with an accommodating cavity, the odor-resistant component is arranged in the accommodating cavity, and the interface further comprises a cover plate, wherein the odor-resistant component comprises a fixed seat and a flip cover hinged on the fixed seat; the fixed seat is arranged on the cover plate, the shell is provided with an opening communicated with the accommodating cavity, and the cover plate covers the opening and is detachably connected with the shell; the shell is provided with two oppositely arranged limit grooves, and the cover plate is correspondingly provided with limit blocks which are clamped in the limit grooves so as to limit axial sliding of the cover plate; an inner side wall of the shell is respectively provided with hooks on both sides of the limit grooves, the cover plate is provided with a first boss, and the hooks are hooked on the first boss so as to limit lateral sliding of the cover plate.

9. The interface with an odor-resistant component according to claim 8, further comprising a buckle, wherein the buckle is detachably connected with the shell, and a first seal is arranged between the buckle and the shell.

10. The interface with an odor-resistant component according to claim 8, wherein a clamping groove is arranged on the cover plate along a circumference thereof, and a sealing ring is arranged in the clamping groove.

11. The interface with an odor-resistant component according to claim 8, wherein an upper side wall of the cover plate is provided with a first convex rib, a first positioning groove is formed between the first convex rib and the upper side wall, and an upper end of the fixed seat is clamped in the first positioning groove.

12. The interface with an odor-resistant component according to claim 11, wherein two inner side walls of the cover plate are provided with second bosses, and a middle part of the fixed seat is erected on the second bosses.

13. The interface with an odor-resistant component according to claim 8, wherein a seal is arranged between the fixed seat and the flip cover.

14. The interface with an odor-resistant component according to claim 11, wherein two second convex ribs are arranged on the inner side wall of the shell, the two second convex ribs are arranged at intervals to form a second positioning groove, and a lower end of the fixed seat is clamped in the second positioning groove.

15. An interface with an odor-resistant component, comprising a shell and an odor-resistant component;

wherein the shell comprises a channel between an inlet and an outlet and a mounting groove communicated with the channel;

the odor-resistant component is mounted in the shell through the mounting groove to block the channel, and the odor-resistant component comprises a fixed seat with an opening and a mounting part detachably connected with the mounting groove;

wherein, the fixed seat is movably connected with a flip cover covering the opening, and the flip cover is opened by a fluid entering the channel to open up the channel or is closed by a load to block the channel, wherein the mounting groove is opened on an outer wall of the shell, and there are two oppositely arranged limit grooves in the mounting groove; the mounting part comprises a cover plate, on which there are corresponding limit blocks matched with the limit grooves; hooks are respectively arranged in the limit grooves on both sides, the cover plate is provided with a first boss, and when the limit blocks are mounted in the limit grooves, the hooks are hooked on the first boss to limit the cover plate from loosening.

16. The interface with an odor-resistant component according to claim 15, wherein the flip cover is connected with the fixed seat through a hinge shaft, the hinge shaft is arranged above the opening of the fixed seat, and a counterweight ball is arranged on the flip cover to form a load on the flip cover.

17. The interface with an odor-resistant component according to claim 15, wherein a periphery of the odor-resistant component is provided with a seal which tightly seals an inner wall of the shell.

* * * * *